US006231701B1

(12) United States Patent
Blomquist

(10) Patent No.: US 6,231,701 B1
(45) Date of Patent: May 15, 2001

(54) VEHICLE OCCUPANT PROTECTION DEVICE AND SOLID SOLUTION GAS GENERATING COMPOSITION THEREFOR

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/250,851

(22) Filed: Feb. 17, 1999

Related U.S. Application Data

(63) Continuation-in-part of application No. 09/052,413, filed on Mar. 31, 1998.

(51) Int. Cl.[7] ..... C06B 45/06; C06B 31/28
(52) U.S. Cl. ..... 149/18; 149/45; 149/46
(58) Field of Search ..... 149/45, 18, 46

(56) References Cited

U.S. PATENT DOCUMENTS

| | | | | |
|---|---|---|---|---|
| 3,369,943 | | 2/1968 | Longwell et al. | 149/18 |
| 5,060,973 | | 10/1991 | Giovanetti | 280/736 |
| 5,062,365 | | 11/1991 | Canterberry | 102/322 |
| 5,223,057 | * | 6/1993 | Mueller | 149/45 |
| 5,386,777 | | 2/1995 | Lou et al. | 102/291 |
| 5,401,341 | | 3/1995 | Forsberg et al. | 149/46 |
| 5,451,277 | | 9/1995 | Katzakian et al. | 149/19.92 |
| 5,547,764 | | 8/1996 | Blais et al. | 428/461 |
| 5,683,104 | | 11/1997 | Smith | 280/736 |
| 5,684,269 | | 11/1997 | Barnes et al. | 149/45 |
| 5,837,931 | * | 11/1998 | Bruenner et al. | 149/45 X |

OTHER PUBLICATIONS

"Diplomarbeit" of Angela Emberger: "Swelling Pressure Measurement of a Gelatin–Water System", 1975, pp. 5, 6, 69.

Colloid & Polymer Sci. 254, pp. 329–341 (1976) "Thermal Dynamic Properties of the Gelatin–Water System".

K, Biederbick: "Kunststoffe" (plastics) Colloid & Polymer Sci. 60, p. 120–129 (1976).

* cited by examiner

*Primary Examiner*—Peter A. Nelson
(74) *Attorney, Agent, or Firm*—Tarolli, Sundheim, Covell, Tummino & Szabo L.L.P.

(57) ABSTRACT

An apparatus (12) for inflating an inflatable vehicle occupant protection device (20) comprises a gas generating material (16) which when ignited produces gas to inflate the inflatable vehicle occupant protection device (20). The gas generating material (16) comprises a solid solution of a water soluble liquid oxidizer, a cross-linked hydrophilic gelling agent, and water. The cross-linked hydrophilic gelling agent comprises an effective amount of carbon atoms to provide a combustible mixture with the liquid oxidizer. The cross-linked hydrophilic gelling agent forms a reticulated structure in which the liquid oxidizer and water are immobilized.

19 Claims, 1 Drawing Sheet

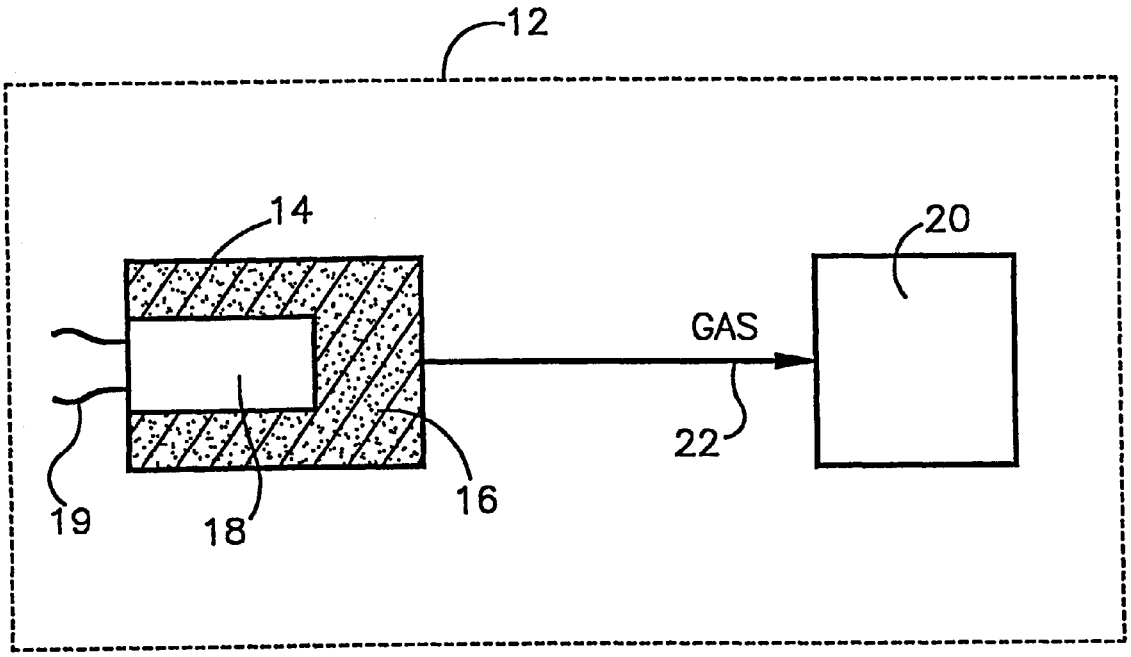
12
14
20
GAS
22
19
18
16

VEHICLE OCCUPANT PROTECTION DEVICE AND SOLID SOLUTION GAS GENERATING COMPOSITION THEREFOR

TECHNICAL FIELD

This application is a continuation-in-part of pending application Ser. No. 09/052,413, filed Mar. 31, 1998, and assigned to the assignee of the present application.

The present invention relates to an apparatus comprising an inflatable vehicle occupant protection device, and particularly relates to a gas generating composition for providing inflation gas for inflating an inflatable vehicle occupant protection device.

BACKGROUND OF THE INVENTION

An inflator for inflating an inflatable vehicle occupant protection device, such as an air bag, contains an ignitable gas generating material. The inflator further includes an igniter. The igniter is actuated so as to ignite the gas generating material when the vehicle experiences a collision for which inflation of the air bag is desired. As the gas generating material burns, it generates a volume of inflation gas. The inflation gas is directed into the air bag to inflate the air bag. When the air bag is inflated, it expands into the vehicle occupant compartment and helps to protect the vehicle occupant.

U.S. Pat. No. 5,060,973 discloses a vehicle occupant restraint apparatus which comprises a liquid gas generating composition. The composition comprises 60% hydroxyl ammonium nitrate (HAN) as an oxidizer, 20% triethanol ammonium nitrate (TEAN) as a fuel, and 20% water. The HAN and TEAN are water soluble.

U.S. Pat. No. 5,223,057 discloses a liquid monopropellant suitable for underwater and surface propulsion of ordnance vehicles. The composition comprises a solution or emulsion of hydroxyl ammonium nitrate (HAN), a water soluble fuel, and water. A number of fuels are listed such as alcohols, glycols, and amines. The amount of water is about 5% to 100% of the combined weight of fuel and oxidant, and functions as a desensitizing agent for the HAN and serves to provide cooling to control the flame temperature of the combustion reaction.

U.S. Pat. No. 5,451,277 discloses a method for preparing solid energetic compositions using liquid oxidizers. Hydroxyl ammonium nitrate (HAN) is listed as a suitable liquid oxidizer. Solid fuel particles such as a metal fuel are coated with a polyvinyl alcohol coating. The polymer-coated particles are dried and then combined with the liquid oxidizer forming a dispersion. The dispersion is cast into a mold. The liquid oxidizer is absorbed by the polymer coating causing aggregation of the dispersion into a rubbery solid mass.

U.S. Pat. No. 5,684,269 discloses a liquid gas generating composition suitable for automotive restraint systems. The composition comprises HAN and a nitrate salt of an amine such as an amino tetrazole.

U.S. patent application Ser. No. 09/052413 discloses a gas generating material comprising a solid solution of a water soluble liquid oxidizer, a hyrophilic gelling agent, and water in an amount of up to about 25% based on the weight of the gas generating material. The gelling agent comprises an effective amount of carbon atoms to form a combustible mixture with the liquid oxidizer in the gas generating material.

SUMMARY OF THE INVENTION

An apparatus for inflating a vehicle occupant protection device comprises a gas generating material. The gas generating material comprises a solid solution of a water soluble liquid oxidizer, a cross-linked hydrophilic polymeric gelling agent, and water. The cross-linked hydrophilic polymeric gelling agent comprises an effective amount of carbon atoms to provide a combustible mixture with the liquid oxidizer. The cross-linked hydrophilic polymeric gelling agent forms a reticulated structure in which the liquid oxidizer and water are immobilized.

The water reduces the temperature of the gas which is produced by combustion of the combustible mixture and also increases the volume of gas, making the gas generating material of the present invention suitable for inflating a vehicle occupant protection device.

In a preferred embodiment of the present invention, the liquid oxidizer is hydroxyl ammonium nitrate and the cross-linked hydrophilic polymeric gelling agent is cross-linked polyvinyl alcohol.

Preferably, the body of gas generating material comprises about 50% to about 90% by weight of the liquid oxidizer, about 5% to about 25% by weight of cross-linked hydrophilic polymeric gelling agent and about 1% to about 5% by weight of water.

Preferably, the ratio of cross-linked polyvinyl alcohol to hydroxyl ammonium nitrate is that ratio which is effective for combustion of carbon in the cross-linked polyvinyl alcohol to carbon dioxide.

BRIEF DESCRIPTION OF THE DRAWING

Further features and advantages of the invention will become more apparent from the following description of the invention with reference to the accompanying drawing in which the Figure is a schematic illustration of an apparatus embodying the present invention.

DESCRIPTION OF PREFERRED EMBODIMENTS OF THE INVENTION

Referring to the Figure, an apparatus 12 embodying the present invention comprises an inflator 14. The inflator 14 contains a gas generating material 16. The gas generating material 16 is ignited by an igniter 18 operatively associated with the gas generating material 16. Electric leads 19 convey current to the igniter 18 from a sensor (not shown) which is responsive to vehicle deceleration above a predetermined threshold. The apparatus 12 also comprises an inflatable vehicle occupant protection device 20. A gas flow means 22 conveys gas, which is generated by combustion of the gas generating material 16 in the inflator 14, to the inflatable vehicle occupant protection device 20.

A preferred inflatable vehicle occupant protection device 20 is an air bag which is inflatable to protect a vehicle occupant in the event of a collision. Other vehicle occupant protection devices which can be used in the present invention are inflatable seat belts, inflatable knee bolsters, inflatable air bags to operate knee bolsters, inflatable head liners, and/or inflatable side curtains.

A vehicle occupant protection apparatus may be exposed to very high temperatures, up to about 85° C. for prolonged periods of time. It is critical that the gas generating material retain its shape at such temperatures. One commonly accepted test is to expose the gas generating material to a constant temperature of about 90° C. for about 1000 hours. This is an accelerated test simulating high temperature conditions to which the vehicle occupant protection apparatus would be exposed over the expected life of the vehicle occupant protection apparatus.

The gas generating material 16 of the present invention is a solid solution that comprises a continuous phase of a cross-linked hydrophilic polymeric gelling agent, which functions as a fuel in the gas generating material, and a discontinuous phase of a water soluble liquid oxidizer, which is gelled by the gelling agent. The gelling agent and oxidizer together produce a combustible mixture. The gas generating material 16 further comprises about 1% to about 5% by weight of water based on the weight of the gas generating material.

The cross-linked hydrophilic polymeric gelling agent is in the form of a reticulated structure comprising a multitude of ligands which are generally of uniform dimension and interconnected with each other to form voids which are open to each other. The liquid oxidizer and water are absorbed into the voids of the reticulated structure. Molecules of the liquid oxidizer react with molecules of the gelling agent in a gelling reaction which immobilizes the liquid oxidizer and water molecules in the reticulated structure voids.

A preferred water soluble liquid oxidizer is hydroxyl ammonium nitrate (HAN). Hydroxyl ammonium nitrate is a water soluble salt which is represented by the formula:

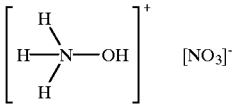

Hydroxyl ammonium nitrate has a molecular weight of 96 and is commercially available as a clear viscous solution comprising about 15% to about 25% by weight of water, based on the combined weight of the hydroxyl ammonium nitrate and water, and about 75% to about 85% by weight of hydroxyl ammonium nitrate, based on the combined weight of the hydroxyl ammonium nitrate and water. A preferred hydroxyl ammonium nitrate for use in the present invention comprises about 18% to about 24% by weight of water based on the combined weight of the hydroxyl ammonium nitrate and water. With this concentration of water, the hydroxyl ammonium nitrate is stable, and has a high decomposition temperature, for instance above about 148° C.

Examples of other liquid water soluble oxidizers that can be used in the practice of the present invention include lower alkyl derivatives of hydroxyl ammonium nitrate such as N-methyl, N-ethyl, O-methyl, O-ethyl, hydrazinium nitrate, and dihydroxyethylammonium nitrate.

The cross-linked hydrophilic polymeric gelling agent in the gas generating material 16 is one which, when employed in a gelling amount, is water soluble and has sufficient carbon atoms to function as a fuel and produce, with the liquid oxidizer, a combustible mixture.

A preferred cross-linked hydrophilic polymeric gelling agent is a cross-linked water soluble synthetic polymer such as a cross-linked polyvinyl alcohol. Polyvinyl alcohol can be represented by the following formula:

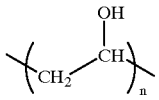

Polyvinyl alcohol is made by the alcoholysis of polyvinyl acetate. It is commercially available as a white cream powder in a range of average molecular weights, from a low molecular weight, low viscosity grade (below 35,000 molecular weight) to a super high molecular weight, super high viscosity grade (250,000 to 300,000 molecular weight). A preferred molecular weight in the present invention is within the range between a low viscosity grade, which is 87% to 89% hydrolyzed and has an average molecular weight of about 13,000 to 23,000, to a mid-viscosity grade, which is 99+% hydrolyzed and has an average molecular weight of about 124,000 to 186,000.

Suitable cross-linking agents for cross-linking polyvinyl alcohol include organo-metallic complexes such as water soluble organic titanates and water soluble organic zirconates. Two suitable cross-linking agents are "TYZOR" TE and "TYZOR" LA. "TYZOR" TE and "TYZOR" LA are organic titanates commercially available from E.I. du Pont de Nemours and Company. "TYZOR" TE (triethanolamine titanate chelate) is a mixture of chelates with at least one chelate the following structural formula:

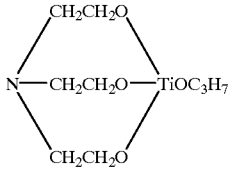

"TYZOR" LA (lactic acid titanate chelate ammonium salt) has the following structural formula:

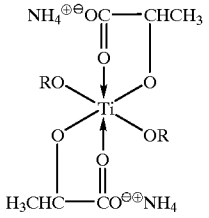

The cross-linking of the polyvinyl alcohol is carried out in an aqueous medium, for instance by dissolving the polyvinyl alcohol in water and adding the cross-linking agent to the polyvinyl alcohol solution. The cross-linking causes the solution to solidify into a semi-rigid reticulated structure defined by a multitude of ligands which are generally of uniform dimension and interconnected so as to provide a plurality of open cells (voids) which are open to each other, similar to the configuration of a conventional sponge. Preferably, the cross-linking is carried out in a mold which gives the reticulated structure a predetermined shape.

When the gelling agent (e.g. polyvinyl alcohol) and liquid oxidizer (e.g. hydroxyl ammonium nitrate) are mixed, the liquid oxidizer and gelling agent enter into a gelling reaction in which molecules of the liquid oxidizer bond to hydroxyl sites of molecules of the gelling agent, for instance by hydrogen bonding. When the gelling agent is cross-linked, providing a reticulated structure comprising a multitude of ligands, the liquid oxidizer is dispersed in reticulated voids of the structure and molecules of the oxidizing agent bond at hydroxyl sites of the gelling agent ligands. This causes the liquid oxidizer to become immobilized in the reticulated structure of the gelling agent. Water in the gas generating material becomes immobilized along with the oxidizer in the gelled reticulated structure.

Other cross-linkable water soluble gelling agents containing substantial carbon atoms and having high temperature thermal stability so as to be useful as fuels include hydroxyl ethyl acrylates, cellulose derivatives such as carboxymethylcellulose and hydroxylpropylcellulose, polymers derived from vinyl esters such as polyvinylpyrolidone or polyvinyl amides, starches such as carboxymethyl starch, alginates, casein, gums, lattices such as styrene-butadiene latex, and mixtures of the same, including mixtures with polyvinyl alcohol.

The gas generating material of the present invention further comprises water in an amount of about 1% to about 5% by weight of the body of gas generating material. About 1% to about 5% water is desirable to cool the products of combustion of the oxidizer and fuel for use in a vehicle occupant restraint, preferably to cool the products of combustion to a temperature less than about 2500K, preferably to a temperature in the range of about 1800K to about 2500K. By cooling the products of combustion, the vehicle occupant restraint can be made of components which are lighter in weight and of less expensive materials.

The amount of cross-linked gelling agent (e.g. cross-linked polyvinyl alcohol) which is used is an effective amount to produce a reticulated structure having good mechanical properties. The inflator must function properly over a wide temperature range, for instance from a low of about −40° C. to a high of about 90° C. This means that the body of gas generating material must have good elasticity and good tensile strength over a wide temperature range. It must be neither brittle at −40° C. nor capable of losing its shape or configuration at 90° C. A preferred amount of cross-linked gelling agent to achieve these properties is in the range of about 5% to about 25% by weight of the gas generating material.

The amount of oxidizing agent in the gas generating composition is an effective amount to form, with the gelling agent, a combustible mixture. Preferably, the amount of oxidizing agent is an amount effective to oxidize the carbon atoms in the cross-linked hydrophilic polymeric gelling agent to predominantly carbon dioxide. A preferred amount of oxidizing agent is within the range of about 50% to about 90% by weight of the gas generating material.

The amount of bonding of the liquid oxidizer to the reticulated structure is an effective amount to resist syneresis of the liquid oxidizer and water when the body of gas generating material is exposed to high temperatures for prolonged periods of time (e.g. a simulated test of 90° C. for about 1000 hours). By syneresis, it is meant the separation of the liquid oxidizer and water from the reticulated structure. This requires that the amount of cross-linker which is used to cross-link the gelling agent be only a partial amount so as to leave substantial sites for bonding with the liquid oxidizer. Generally, a partial amount is approximately the minimum amount required to transform the gelling agent solution (e.g. polyvinyl alcohol solution to a reticulated structure).

The gas generating material or solid solution of the present invention consists essentially of a liquid oxidizer, a cross-linked gelling agent, and water bound into the cross-linked gelled structure. However, in the preferred embodiment, other ingredients can be incorporated into the gas generating material in small amounts.

For instance, the gas generating material can include up to about 5 weight percent, based on the weight of the body of gas generating material, of ammonium nitrate. The ammonium nitrate enhances the burn rate of the gas generating composition, reducing the amount of hydroxyl ammonium nitrate required. The ammonium nitrate also forms an eutectic with the hydroxyl ammonium nitrate which tends to improve mechanical properties of the gas generating material, for instance, low temperature properties such as resisting embrittlement. Derivatives of ammonium nitrate can also be used.

The gas generating material can also comprise small amounts of a stabilizer such as a pyridine, pyridine salt, or an acid of pyridine, as disclosed in U.S. Pat. No. 5,703,323. An example of one such stabilizer is 2-hydroxypyridine-N-oxide sodium salt. The abbreviation for this salt is NaHPNO. The stabilizer is primarily a sequestrant for iron. Other suitable sequestrants that can be used are "DEQUEST" phosphonates marketed by Monsanto Company such as "DEQUEST 2054" [hexamethylenediamine tetra (methylenephosphonic acid)potassium salt] and "DEQUEST 2041" [alkylenediamine tetra (methylenephosphonic acid)potassium salt].

The gas generating material can also comprise a burn rate catalyst such as a borohydride, chromium, copper, guanidinium chloride (GNX), hydroxylamine chloride (HAX), and nitroaminotetrazole. Encapsulation of the catalyst may be desirable to avoid decomposition or premature aging of the hydroxyl ammonium nitrate. The presence of metal particles to which the hydroxyl ammonium nitrate may be particularly sensitive, such as metal fuel particles, e.g., particles of aluminum, is not preferred as such particles can cause the composition to have, on combustion, too high an impetus value. The impetus value is expressed as joules per gram, and is an indication of the amount of energy produced in the combustion reaction.

The gas generating material may have embedded in it a non-combustible preform. Preferably, the preform is an interconnected metal wire structure embedded into the gas generating material. During combustion of the gas generating material, the preform is heated, cooling the products of combustion. The heated preform facilitates conversion of toxic gases such as nitrogen oxides and carbon monoxide to nitrogen and carbon dioxide, respectively. Further, the non-combustible preform serves as a combustion stabilizer by damping of pressure and sound waves.

The gas generating material of the present invention can be made by variety of methods. One suitable method is to dissolve the gelling agent in water and then cross-link it with the addition of a cross-linking agent to the gelling agent solution to form a sponge-like reticulated structure. The cross-linking is preferably carried out in a mold giving the reticulated structure a predetermined shape. The reticulated structure is then submerged in an aqueous solution of the oxidizer. The oxidizer solution is absorbed into the reticulated structure by capillary attraction. This swells the reticulated structure, but the structure retains its predetermined shape due to the strength of the cross-linking. Molecules of the liquid oxidizer and water bond to sites of the reticulated structure causing the liquid oxidizer and water to become gelled. This immobilizes the liquid oxidizer and water within the reticulated structure. The mixture is then dried until gas generating material comprises about 5% or less by weight of water. By limiting the cross-linking to essentially that required to produce a semi-rigid structure, sufficient oxidizer is gelled within the reticulated structure to produce a combustible mixture of oxidizer and gelling agent.

Another method is to simply mix all of the components of the body of gas generating material in a mold so that the gelling and cross-linking occur simultaneously.

EXAMPLE 18.14 mg of polyvinyl alcohol, in powder form, is placed in a sacrificial mold. The polyvinyl alcohol has a high degree of hydrolysis, about 85%, and an average molecular weight of about 98,000. Water is added to the mold to stabilize the polyvinyl alcohol. The amount of water added is an effective amount to create a non-viscous 10% solids solution. At 85% hydrolysis, polyvinyl alcohol is soluble in hot or cold water.

8.78 mg of "TYZOR" TE is then added to and mixed with the polyvinyl alcohol solution. "TYZOR" TE is an oraganometallic crosslinking agent commercially available from E.I DuPont de Nemours and Company. The "TYZOR" TE is dissolved in a sufficient amount of water to form a viscous slurry prior to the addition of the "TYZOR" TE to the polyvinyl alcohol solution.

The "TYZOR" TE undergoes alcoholysis with the polyvinyl alcohol as follows:

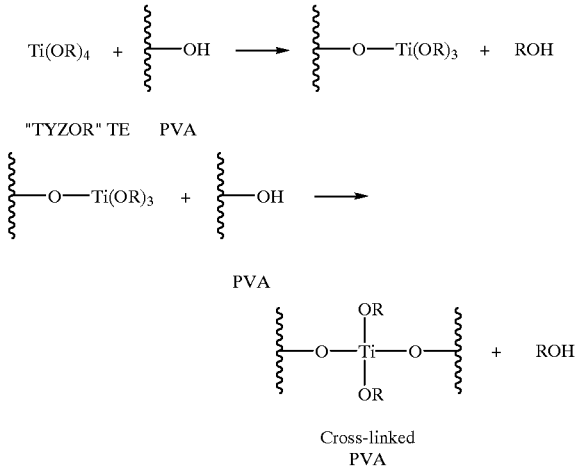

The amount of cross-linking is an effective amount, preferably a minimum amount, for the polyvinyl alcohol to set up in the mold into a semi-rigid structure. This leaves adequate sites for gelling the oxidizing agent. The cross-linked polyvinyl alcohol structure is then removed from the mold and dried to essentially complete dryness. The dried structure has a reticulated open cell structure similar to that of a sponge.

The cross-linked open cell structure is then submerged in an aqueous solution of hydroxyl ammonium nitrate (80% hydroxyl ammonium nitrate/20% water) which has been stabilized with 2-hydroxypyridine-N-oxide sodium salt (NaHPNO). Molecules of the stabilized hydroxyl ammonium nitrate flow into the open cells by capillary attraction. The stabilized hydroxyl ammonium nitrate bonds at hydroxyl sites on the ligands of the cross-linked polyvinyl alcohol by hydrogen bonding. This results in a gelled structure with a continuous cross-linked polyvinyl alcohol phase and a discontinuous stabilized hydroxyl ammonium nitrate phase.

The gelling reaction can be characterized as one in which the hydroxyl ammonium nitrate swells the cross-linked polyvinyl alcohol structure. However, because of the cross-linking, the physical dimensions of the gelled cross-linked polyvinyl alcohol structure remains the same.

The gelled cross-linked polyvinyl alcohol structure is then heated at a temperature of about 100° C. for 24 hours to remove excess water. The gelled structure is cooled to room temperature and then cut into bodies of gas generating material having an aspirin tablet configuration.

The gas generating material so formed has a weight ratio of polyvinyl alcohol to ammonium nitrate of about 3.5:1. This ratio is approximately stoichiometric. The gas generating material has a water content of about 5% by weight. The gas generating material retains its rigidity even when exposed to elevated temperatures, e.g. 90° C., for prolonged periods of time. The gas generating material also resists moisture loss.

Advantages of the present invention should be apparent. The gas generating material is particularly suitable for inflating a vehicle occupant protection device. The gas generating material produces a gas product upon combustion which is non-toxic and free of particulates. The present invention offers a means for providing a relatively cool gas while at the same time producing an adequate volume of gas. The gas generating material has good burn rate characteristics, good mechanical properties over a wide temperature range, and resists aging.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for inflating an inflatable vehicle occupant protection device comprising a gas generating material, said gas generating material comprising a solid solution of a water soluble liquid oxidizer, a cross-linked hydrophilic polymeric gelling agent, and water;

wherein said gelling agent comprises an effective amount of carbon atoms to provide a combustible mixture with said liquid oxidizer; and wherein said cross-linked hydrophilic gelling agent forms a reticulated structure in which the liquid oxidizer and water are immobilized.

2. The apparatus of claim 1 wherein said liquid oxidizer is hydroxyl ammonium nitrate or a derivative thereof.

3. The apparatus of claim 1 wherein said cross-linked hydrophilic gelling agent is cross-linked polyvinyl alcohol.

4. The apparatus of claim 1 wherein said the amount of water soluble liquid oxidizer in gas generating material is that amount effective to oxidize the carbon atoms in cross-linked hydrophilic polymeric gelling agent to carbon dioxide.

5. The apparatus of claim 4 wherein the amount of water soluble liquid oxidizer in the gas generating material is about 50% to about 90% by weight of the gas generating material.

6. The apparatus of claim 1 wherein the amount of cross-linked polymeric hydrophilic gelling agent in the gas generating material is about 5% to about 25% by weight of the gas generating material.

7. The apparatus of claim 1 wherein the amount of water in the gas generating material is about 1% to about 5% by weight of the gas generating material.

8. The apparatus of claim 1 wherein said gas generating material further comprises up to about 5% by weight of ammonium nitrate by weight of the gas generating material.

9. The apparatus of claim 1 wherein the gas generating material further comprises a stabilizer.

10. The apparatus of claim 1 wherein the gas generating material further comprises a burn rate catalyst.

11. The apparatus of claim 1 further comprising a non-combustible preform embedded in the gas generating material.

12. An apparatus for inflating an inflatable vehicle occupant protection device comprising a gas generating material, said gas generating material comprising a solid solution of a hydroxyl ammonium nitrate, cross-linked polyvinyl alcohol, and water;

wherein said cross-linked polyvinyl alcohol comprises an effective amount of carbon atoms to provide a combustible mixture with said hydroxyl ammonium nitrate; and wherein said cross-linked polyvinyl alcohol forms a reticulated structure in which the hydroxyl ammonium nitrate and water are immobilized.

13. The apparatus of claim 12 wherein the amount of hydroxyl ammonium nitrate in gas generating material is that amount effective to oxidize the carbon atoms in cross-linked polyvinyl alcohol to carbon dioxide.

14. The apparatus of claim 12 wherein the amount of hydroxyl ammonium nitrate in the gas generating material is about 50% to about 90% by weight of the gas generating material.

15. The apparatus of claim 12 wherein the amount of cross-linked polyvinyl alcohol in the gas generating material is about 5% to about 25% by weight of the gas generating material.

16. The apparatus of claim 12 wherein the amount of water in the gas generating material is about 1% to about 5% by weight of the gas generating material.

17. A gas generating material comprising a solid solution of a water soluble liquid oxidizer, a hydrophilic gelling agent, a cross-linking agent, and water;

said hydrophilic gelling agent comprising an effective amount of carbon atoms to provide a combustible mixture with said liquid oxidizer;

said cross-linking agent cross-linking said hydrophilic gelling agent and forming a reticulated structure in which said liquid oxidizer and water are immobilized.

18. The gas generating material of claim 17 wherein said cross-linking agent comprises an organo-metallic complex.

19. The gas generating material of claim 18 wherein said organo-metallic complex is selected from group consisting of water soluble organic titanates and water soluble organic zirconates.

* * * * *